US008728999B2

(12) United States Patent
Carey et al.

(10) Patent No.: US 8,728,999 B2
(45) **Date of Patent: *May 20, 2014**

(54) METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

(75) Inventors: Vincent M. Carey, Sewell, NJ (US); Kevin L. Crouthamel, Richboro, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 350 days.

This patent is subject to a terminal disclaimer.

(21) Appl. No.: 13/016,554

(22) Filed: Jan. 28, 2011

(65) Prior Publication Data

US 2011/0207639 A1 Aug. 25, 2011

Related U.S. Application Data

(60) Provisional application No. 61/337,205, filed on Feb. 1, 2010.

(51) Int. Cl.
*C10M 111/04* (2006.01)
*C10M 159/20* (2006.01)
*C10M 169/04* (2006.01)

(52) U.S. Cl.
USPC ..... 508/591; 508/391; 508/460; 508/586

(58) Field of Classification Search
USPC ..... 508/591
See application file for complete search history.

(56) References Cited

U.S. PATENT DOCUMENTS

| | | | |
|---|---|---|---|
| 2,978,442 | A | 4/1961 | Brightbill et al. |
| 3,149,178 | A | 9/1964 | Hamilton et al. |
| 3,164,578 | A | 1/1965 | Baker et al. |
| 3,382,291 | A | 5/1968 | Brennan |

(Continued)

FOREIGN PATENT DOCUMENTS

| | | |
|---|---|---|
| EP | 0119069 A2 | 9/1984 |
| EP | 0119792 A1 | 9/1984 |

(Continued)

OTHER PUBLICATIONS

Ferdinand Rodrigues, "The Molecular Weight of Polymers in Principles of Polymer Systems", Chapter 6, McGraw-Hill, 1970, pp. 115-144.

(Continued)

*Primary Examiner* — Ellen McAvoy
(74) *Attorney, Agent, or Firm* — Robert A. Migliorini; Derek Kato

(57) ABSTRACT

The present invention is directed to a method for improving the fuel efficiency of large low and medium speed engine oil compositions by reducing the traction coefficient of the oil by formulating the oil using a blend consisting of one or more Group I base oils having a kinematic viscosity at 100° C. of from 2 to less than 12 $mm^2/s$ in combination with a Group IV base oil having a kinematic viscosity of at least 38, the difference in kinematic viscosity between the Group I and Group IV oils in the blend being at least 30 $mm^2/s$ in combination with a detergent.

9 Claims, 1 Drawing Sheet

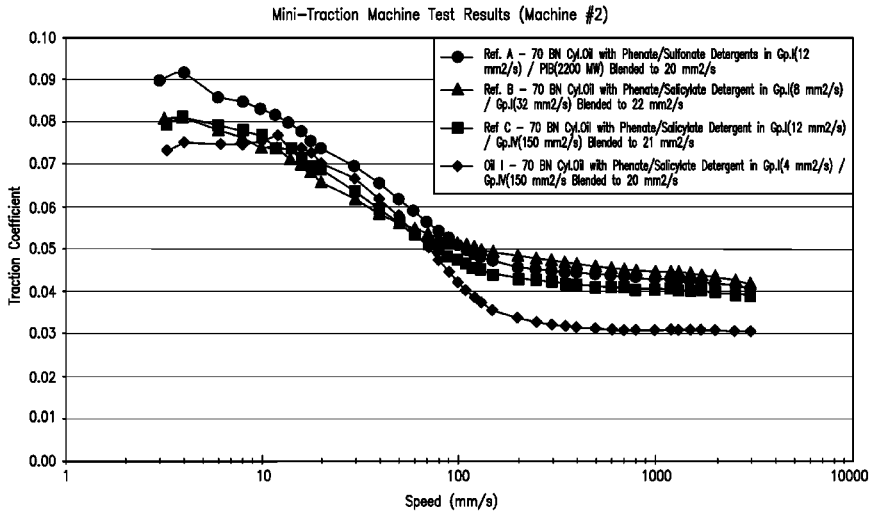

(56) References Cited

U.S. PATENT DOCUMENTS 3,576,923 A 4/1971 Randell et al.
3,742,082 A 6/1973 Brennan
3,769,363 A 10/1973 Brennan
3,780,128 A 12/1973 Shubkin
3,876,720 A 4/1975 Heilman
3,883,417 A 5/1975 Woo et al.
4,016,349 A 4/1977 McKenna
4,056,122 A 11/1977 Schlieckmann et al.
4,132,663 A 1/1979 Heilman et al.
4,149,178 A 4/1979 Estes
4,172,855 A 10/1979 Shubkin et al.
4,218,330 A 8/1980 Shubkin
4,234,435 A 11/1980 Meinhardt et al.
4,239,930 A 12/1980 Allphin et al.
4,263,150 A 4/1981 Clason et al.
4,263,465 A 4/1981 Sheng et al.
4,289,635 A 9/1981 Schroeck
4,308,154 A 12/1981 Clason et al.
4,367,352 A 1/1983 Watts, Jr. et al.
4,413,156 A 11/1983 Watts, Jr. et al.
4,417,990 A 11/1983 Clason et al.
4,434,408 A 2/1984 Baba et al.
4,451,684 A 5/1984 Pasky
4,469,912 A 9/1984 Blewett et al.
4,587,368 A 5/1986 Pratt
4,652,416 A 3/1987 Millot
4,701,489 A 10/1987 Hughes et al.
4,704,491 A 11/1987 Tsutsui et al.
4,776,967 A 10/1988 Ichihashi et al.
4,827,064 A 5/1989 Wu
4,827,073 A 5/1989 Wu
4,892,851 A 1/1990 Ewen et al.
4,906,350 A 3/1990 Lucien et al.
4,906,799 A 3/1990 Forbus, Jr. et al.
4,910,355 A 3/1990 Shubkin et al.
4,912,272 A 3/1990 Wu
4,914,254 A 4/1990 Pelrine
4,922,046 A 5/1990 Kinoshita et al.
4,926,004 A 5/1990 Pelrine et al.
4,943,383 A 7/1990 Avery et al.
4,950,822 A 8/1990 Dileo et al.
4,956,122 A 9/1990 Watts et al.
4,962,249 A 10/1990 Chen et al.
4,962,262 A 10/1990 Winter et al.
4,967,032 A 10/1990 Ho et al.
4,990,709 A 2/1991 Wu
5,012,020 A 4/1991 Jackson et al.
5,017,299 A 5/1991 Gutierrez et al.
5,017,714 A 5/1991 Welborn, Jr.
5,057,235 A 10/1991 Farng et al.
5,068,487 A 11/1991 Theriot
5,075,269 A 12/1991 Degnan et al.
5,087,788 A 2/1992 Wu
5,104,579 A 4/1992 Benjamin et al.
5,105,038 A 4/1992 Chen et al.
5,113,030 A 5/1992 Chen et al.
5,132,478 A 7/1992 Ho et al.
5,146,021 A 9/1992 Jackson et al.
5,157,177 A 10/1992 Pelrine et al.
5,177,276 A 1/1993 Beach et al.
5,180,865 A 1/1993 Heilman et al.
5,186,851 A 2/1993 Gutierrez et al.
5,187,250 A 2/1993 Asanuma et al.
5,188,724 A 2/1993 Heilman et al.
5,188,746 A 2/1993 Davis
5,190,682 A 3/1993 Harris
5,208,403 A 5/1993 Buchanan et al.
5,220,100 A 6/1993 Massie et al.
5,243,114 A 9/1993 Johnson et al.
5,254,274 A 10/1993 Ho et al.
5,264,642 A 11/1993 Wu
5,275,749 A 1/1994 Kugel et al.
5,276,227 A 1/1994 Wu et al.
5,276,277 A 1/1994 Hightower et al.
5,315,053 A 5/1994 Beach et al.
5,369,196 A 11/1994 Matsumoto et al.
5,382,739 A 1/1995 Atkins et al.
5,436,379 A 7/1995 Heilman et al.
5,462,995 A 10/1995 Hosaka et al.
5,498,815 A 3/1996 Schaerfl, Jr. et al.
5,602,086 A 2/1997 Le et al.
5,679,812 A 10/1997 Winter et al.
5,688,887 A 11/1997 Bagheri et al.
5,705,577 A 1/1998 Rossi et al.
5,726,133 A 3/1998 Blahey et al.
5,731,254 A 3/1998 Winter et al.
5,807,949 A 9/1998 Rossi et al.
5,811,379 A 9/1998 Rossi et al.
5,817,605 A 10/1998 Papay
5,846,896 A 12/1998 Ewen
5,852,143 A 12/1998 Sishta et al.
5,858,935 A 1/1999 Watts et al.
5,859,159 A 1/1999 Rossi et al.
6,043,401 A 3/2000 Bagheri et al.
6,080,301 A 6/2000 Berlowitz et al.
6,087,307 A 7/2000 Kaminski et al.
6,090,989 A 7/2000 Trewella et al.
6,133,209 A 10/2000 Rath et al.
6,140,281 A 10/2000 Blahey et al.
6,143,701 A * 11/2000 Boffa ..... 508/363
6,147,271 A 11/2000 Strebel et al.
6,165,949 A 12/2000 Berlowitz et al.
6,180,575 B1 1/2001 Nipe
6,184,186 B1 2/2001 Ryan et al.
6,191,081 B1 2/2001 Cartwright et al.
6,339,051 B1 * 1/2002 Carey et al. ..... 508/391
6,388,032 B1 5/2002 Yamaura et al.
6,395,948 B1 5/2002 Hope et al.
6,414,090 B2 7/2002 Minami et al.
6,429,178 B1 8/2002 Skinner et al.
6,479,722 B1 11/2002 De Wet et al.
6,548,723 B2 4/2003 Bagheri et al.
6,548,724 B2 4/2003 Bagheri et al.
6,589,920 B2 7/2003 Okada et al.
6,613,724 B2 9/2003 Strickland et al.
6,642,169 B2 11/2003 Weatherhead
6,645,922 B2 11/2003 Dunn et al.
6,646,174 B2 11/2003 Clarembeau
6,706,828 B2 3/2004 DiMaio
6,713,438 B1 3/2004 Baillargeon et al.
6,790,813 B2 * 9/2004 Boffa ..... 508/198
6,824,671 B2 11/2004 Goze et al.
6,858,767 B1 2/2005 DiMaio et al.
6,869,917 B2 3/2005 Deckman et al.
7,022,784 B2 4/2006 Wu et al.
7,045,055 B2 5/2006 Ziemer et al.
7,060,768 B2 6/2006 Brookhart et al.
7,101,830 B2 9/2006 Owen et al.
7,129,197 B2 10/2006 Song et al.
7,312,185 B2 12/2007 Willey et al.
7,407,919 B2 * 8/2008 Wilk et al. ..... 508/399
7,476,645 B2 * 1/2009 Rosenbaum et al. ..... 508/110
7,544,850 B2 6/2009 Goze et al.
7,547,811 B2 6/2009 Kramer et al.
7,585,820 B2 * 9/2009 Kleijwegt ..... 508/192
7,585,823 B2 9/2009 Sullivan et al.
7,592,411 B2 9/2009 Wu et al.
7,592,497 B2 9/2009 Yang et al.
7,683,013 B2 * 3/2010 Carey et al. ..... 508/110
7,704,930 B2 * 4/2010 Deckman et al. ..... 508/460
7,795,194 B2 9/2010 Iimura et al.
7,989,408 B2 * 8/2011 Poirier et al. ..... 508/486
8,105,991 B2 * 1/2012 Dowding et al. ..... 508/391
8,143,200 B2 * 3/2012 Vaughn et al. ..... 508/110
8,299,007 B2 * 10/2012 Carey et al. ..... 508/591
2001/0041817 A1 11/2001 Bagheri et al.
2001/0041818 A1 11/2001 Bagheri et al.
2002/0144853 A1 10/2002 Martin
2003/0013623 A1 1/2003 Tse et al.
2003/0055184 A1 3/2003 Song et al.
2003/0092585 A1 5/2003 O'Connor et al.
2003/0158055 A1 8/2003 Deckman et al.
2003/0191032 A1 10/2003 Deckman et al.
2003/0207775 A1 11/2003 Sullivan et al.

(56) References Cited

U.S. PATENT DOCUMENTS

| | | | | |
|---|---|---|---|---|
| 2003/0236177 | A1 | 12/2003 | Wu et al. | |
| 2004/0002429 | A1 | 1/2004 | Forbus, Jr. | |
| 2004/0029747 | A1 | 2/2004 | Emert et al. | |
| 2004/0033908 | A1 | 2/2004 | Deckman et al. | |
| 2004/0087746 | A1 | 5/2004 | Razavi | |
| 2004/0092408 | A1 | 5/2004 | Willey et al. | |
| 2004/0097772 | A1 | 5/2004 | Deckers et al. | |
| 2004/0147693 | A1 | 7/2004 | DiMaio | |
| 2004/0214733 | A1 | 10/2004 | Baba | |
| 2004/0220359 | A1 | 11/2004 | Abhari et al. | |
| 2004/0225088 | A1 | 11/2004 | Vaughan et al. | |
| 2004/0230016 | A1 | 11/2004 | Blackborow et al. | |
| 2005/0059563 | A1 | 3/2005 | Sullivan et al. | |
| 2005/0101761 | A1 | 5/2005 | Lambert et al. | |
| 2005/0113621 | A1 | 5/2005 | Hope et al. | |
| 2005/0124509 | A1 | 6/2005 | Gutierrez et al. | |
| 2005/0148478 | A1 | 7/2005 | Ozbalik et al. | |
| 2005/0183988 | A1 | 8/2005 | Freerks et al. | |
| 2005/0250657 | A1 | 11/2005 | Wu et al. | |
| 2006/0116300 | A1 | 6/2006 | Arrowsmith et al. | |
| 2006/0116303 | A1 | 6/2006 | Iimura et al. | |
| 2006/0122073 | A1 | 6/2006 | Hewette | |
| 2006/0131210 | A1 | 6/2006 | Rosenbaum et al. | |
| 2006/0157383 | A1 | 7/2006 | Wu et al. | |
| 2006/0178279 | A1 | 8/2006 | Sullivan et al. | |
| 2006/0199743 | A1 | 9/2006 | Rosenbaum et al. | |
| 2006/0270568 | A1 | 11/2006 | Kawata | |
| 2006/0276355 | A1 | 12/2006 | Carey et al. | |
| 2006/0281643 | A1 | 12/2006 | Habeeb et al. | |
| 2007/0000807 | A1 | 1/2007 | Wu et al. | |
| 2007/0043248 | A1 | 2/2007 | Wu et al. | |
| 2007/0208151 | A1 | 9/2007 | Okada et al. | |
| 2007/0289897 | A1 | 12/2007 | Carey et al. | |
| 2007/0298990 | A1* | 12/2007 | Carey et al. | 508/591 |
| 2008/0020954 | A1* | 1/2008 | Haigh et al. | 508/384 |
| 2008/0177121 | A1 | 7/2008 | Wu et al. | |
| 2008/0207475 | A1 | 8/2008 | Haigh et al. | |
| 2009/0005279 | A1 | 1/2009 | Wu et al. | |
| 2009/0011963 | A1* | 1/2009 | Anderson et al. | 508/192 |
| 2009/0036725 | A1* | 2/2009 | Wu et al. | 585/521 |
| 2009/0042753 | A1 | 2/2009 | Poirier et al. | |
| 2009/0088356 | A1 | 4/2009 | Hee et al. | |
| 2009/0093657 | A1 | 4/2009 | Buchanan et al. | |
| 2009/0156874 | A1 | 6/2009 | Patil et al. | |
| 2009/0186784 | A1 | 7/2009 | Diggs et al. | |
| 2009/0240012 | A1 | 9/2009 | Patil et al. | |
| 2010/0006259 | A1 | 1/2010 | Mori et al. | |
| 2010/0048438 | A1 | 2/2010 | Carey et al. | |
| 2010/0062959 | A1* | 3/2010 | Vaughn et al. | 508/591 |
| 2010/0087349 | A1 | 4/2010 | Lee et al. | |
| 2010/0105585 | A1 | 4/2010 | Carey et al. | |
| 2010/0256026 | A1 | 10/2010 | Wu et al. | |
| 2010/0292424 | A1 | 11/2010 | Wu et al. | |
| 2010/0323937 | A1* | 12/2010 | Wu et al. | 508/591 |
| 2011/0082061 | A1 | 4/2011 | Carey et al. | |
| 2011/0082063 | A1 | 4/2011 | Carey et al. | |
| 2011/0136714 | A1* | 6/2011 | Haigh et al. | 508/583 |

FOREIGN PATENT DOCUMENTS

| | | | |
|---|---|---|---|
| EP | 0088453 | B1 | 5/1987 |
| EP | 0276320 | B1 | 8/1988 |
| EP | 0277004 | A1 | 8/1988 |
| EP | 0277007 | B1 | 8/1988 |
| EP | 0284708 | B1 | 10/1988 |
| EP | 0291006 | B1 | 11/1988 |
| EP | 0321852 | B1 | 6/1989 |
| EP | 0349276 | B1 | 1/1990 |
| EP | 0377306 | B1 | 7/1990 |
| EP | 0403866 | A1 | 12/1990 |
| EP | 0513380 | B1 | 11/1992 |
| EP | 0680942 | A1 | 5/1994 |
| EP | 0613873 | A2 | 9/1994 |
| EP | 0930320 | A1 | 7/1997 |
| EP | 1028128 | A1 | 10/1997 |
| EP | 0992517 | A2 | 9/1998 |
| EP | 1309633 | B1 | 8/2000 |
| EP | 1308496 | B1 | 5/2003 |
| EP | 1342707 | A2 | 9/2003 |
| EP | 1607415 | A1 | 12/2005 |
| EP | 1661921 | A1 | 5/2006 |
| GB | 938069 | | 9/1963 |
| IN | 191553 | | 12/2003 |
| JP | 6336590 | A | 12/1994 |
| JP | 200500446 | A | 7/2005 |
| WO | 9623751 | | 8/1996 |
| WO | 9804658 | | 2/1998 |
| WO | 9967347 | | 6/1999 |
| WO | 9964543 | | 12/1999 |
| WO | 0058423 | | 10/2000 |
| WO | 0214384 | A2 | 2/2002 |
| WO | 02083826 | A1 | 10/2002 |
| WO | 2008102114 | A1 | 10/2002 |
| WO | 03009136 | A1 | 1/2003 |
| WO | 03020856 | A1 | 3/2003 |
| WO | 03051943 | A1 | 6/2003 |
| WO | 03071369 | A1 | 8/2003 |
| WO | 03104292 | A1 | 12/2003 |
| WO | 2004046214 | A2 | 6/2004 |
| WO | 2004053030 | A2 | 6/2004 |
| WO | 2005111178 | A1 | 12/2005 |
| WO | 2006071595 | A2 | 7/2006 |
| WO | 2006083632 | A1 | 8/2006 |
| WO | 2007/011832 | A1 | 1/2007 |
| WO | 2007005094 | A1 | 1/2007 |
| WO | 2007011832 | A1 | 1/2007 |
| WO | 2007145924 | A1 | 12/2007 |
| WO | 2007146081 | A1 | 12/2007 |
| WO | 2008010865 | A2 | 1/2008 |
| WO | 2008011338 | A2 | 1/2008 |
| WO | 2009017953 | A2 | 2/2009 |
| WO | 2009/123800 | A1 | 10/2009 |
| WO | 2009137264 | A1 | 11/2009 |

OTHER PUBLICATIONS

J. Brennan, "Wide-Temperature Range Synthetic Hydrocarbon Fluids", Ind. Eng. Chem. Prod. Res. Dev., 1980, vol. 19, pp. 2-6.

K. Denbigh, "The Kinetics of Continuous Reaction Processes: Application to Polymerization", J. Applied Chem; 1951, vol. 1, pp. 227-236.

K. Denbigh, "Continuous Reactions: Part II. The Kinetics of Steady State Polymerisation", Trans Faraday Soc., 1947, vol. 43, pp. 648-660.

A. Munoz-Escalona, et al., "Single-Site Supported Catalysts for Ethylene Polymerization", Metallocene Tech., 1999, pp. 2242-2246.

Z. Fan, et al., "Effect of Ethoxy- and Methoxysilane Donors in Propene/1-Hexene Copolymerization with High-Yield Supported Ziegler-Natta Catalysts", Macromolecular Chemistry and Physics, 1994, vol. 195, pp. 3889-3899.

G. Gokel, ed., "Dean's Handbook of Organic Chemistry", 2nd Edition, McGraw-Hill, 2004, available on-line at hhtp://knovel.com.

M. LeVan, et al., "Adsorption and Ion Exchange", Perry's Chemical Engineer's Handbook, 7th ed., 1997, pp. 16-1-16-66.

O. Levenspiel, "Ch. 7: Design for Multiple Reactions", Chemical Reaction Engineering, 2nd ed., 1972, pp. 196-209.

N. Naga, et al., "Effect of Co-Catalyst System on a-Olefin Polymerization with Rac- and Meso-[Dimethylsilylenebis (2,3,5-Trimethyl-Cyclopentadienyl)] Zirconium Dichloride", Macromol. Rapid Commun., 1997, vol. 18, pp. 581-589.

N. Naga, et al., "Polymerization Behavior of a-Olefins with Rac- and Meso-Type Ansa-Metallocene Catalyst: Effects of Cocatalyst and Metallocene Ligand", Macromolecular Chemistry Physics, 1999, vol. 200, pp. 1587-1594.

F. Rodriguez, "The Molecular Weight of Polymers", Principles of Polymer Systems, 1970, Chapter 6, pp. 115-144.

M. Sacchi, et al., "Use of Different Alkoxysilanes as External Donors in MgCl2-Supported Ziegler-Natta Catalysts to Obtain Propene/1-Butene Copolymers with Different Microstructure", Macromolecular Chemistry and Physics, 1994, vol. 195, pp. 2805-2816.

(56) References Cited

OTHER PUBLICATIONS

T. Seraidaris, et al., "High-Molar-Mass Polypropene with Tunable Elastic Properties by Hafnocene/Borate Catalysts", Journal of Polymer Science: Part A: Polymer Chemistry, 2006, vol. 44, pp. 4743-4751.
J. Wills, "Synthetic Lubricants", Lubrication Fundamentals, Marcel Dekker Inc., New York, 1980, pp. 75-80.
"Mobil Releases SuperSyn PAO's", Lubrication Engineers, 1999, vol. 55, Part 8, pp. 45.
TIBA data, "TIBA datasheet" available on-line at www.albermarle.com on Aug. 26, 2010.
ASTM D3427-03, "Standard Test Method for Air Release Properties of Petroleum Oils".
http://www.mobil.com/USA, Mobilgear®SHC XMP Series.
http://www.famm11c.com/famm/lubricant_product.asp?gearoils&&wPinnacleMarineGear220, Pinnacle® Marine Gear 220.
Rudnick, Leslie R., "Synthetics, Mineral Oils, and Bio-Based Lubricants Chemistry and Technology", published by CRC Press, Taylor & Francis Group, 2006, 37-46.
Corsico, G., et al., "Poly(internal olefins)", Euron, Milan, Italy, Chemical Industries (Dekker), 1999, 77(Synthetic Lubricants and High-Performance Functional Fluids, 2nd Edition, 53-62.
Kirk-Othmer Encyclopedia of Chemcial Technology, Second completely revised edition, "Diamines and Higher Amines, Aliphatic", vol. 7, 1965, published by John Wiley & Sons, Inc., 22-39.

* cited by examiner

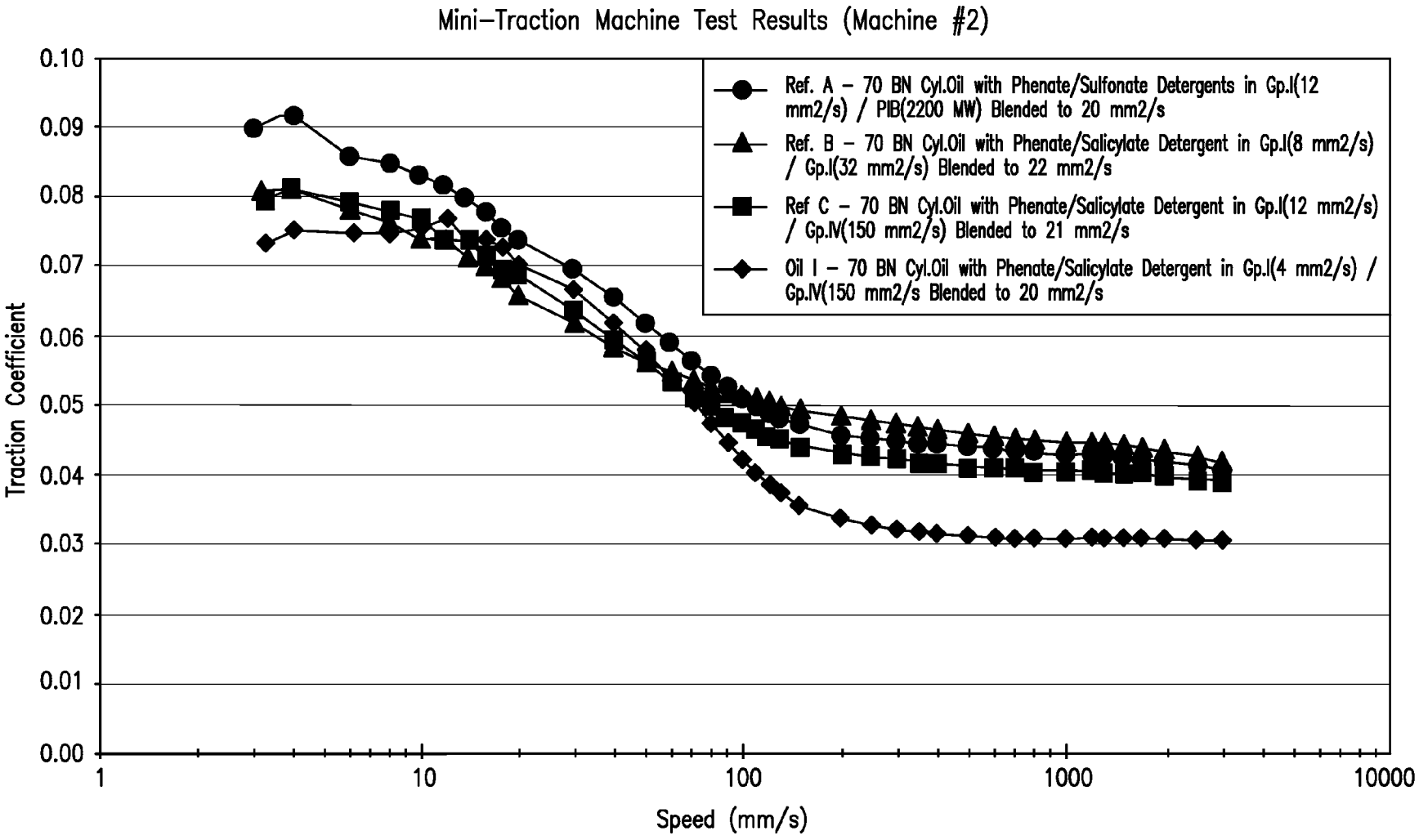
Mini-Traction Machine Test Results (Machine #2)
Ref. A – 70 BN Cyl.Oil with Phenate/Sulfonate Detergents in Gp.I(12 mm2/s) / PIB(2200 MW) Blended to 20 mm2/s
Ref. B – 70 BN Cyl.Oil with Phenate/Salicylate Detergent in Gp.I(8 mm2/s) / Gp.I(32 mm2/s) Blended to 22 mm2/s
Ref C – 70 BN Cyl.Oil with Phenate/Salicylate Detergent in Gp.I(12 mm2/s) / Gp.IV(150 mm2/s) Blended to 21 mm2/s
Oil I – 70 BN Cyl.Oil with Phenate/Salicylate Detergent in Gp.I(4 mm2/s) / Gp.IV(150 mm2/s Blended to 20 mm2/s
Traction Coefficient
0.10
0.09
0.08
0.07
0.06
0.05
0.04
0.03
0.02
0.01
0.00
1
10
100
1000
10000
Speed (mm/s)

METHOD FOR IMPROVING THE FUEL EFFICIENCY OF ENGINE OIL COMPOSITIONS FOR LARGE LOW AND MEDIUM SPEED ENGINES BY REDUCING THE TRACTION COEFFICIENT

This application claims benefit of U.S. Provisional Application No. 61/337,205 filed Feb. 1, 2010.

BACKGROUND OF THE INVENTION

1. Field of the Invention

The present invention relates to the operation of large low and medium speed engines using additized lubricating oil formulations.

2. Description of the Related Art

Diesel engines designed for marine and stationary power applications can be either 2-stroke or 4-stroke cycle having up to 20 cylinders and are typically classified as low-speed, medium-speed or high-speed diesel engines. These engines burn a wide variety of fuels ranging from residual or heavy fuel oils to natural gas (diesel compression or spark-ignited) and are most commonly used for marine propulsion, marine auxiliary (vessel electricity generation), distributed power generation, and combined heating and power (CHP). Lubrication of such engines can be all-loss (i.e., lubricant fed directly to the cylinder by cylinder oil) or recirculation involving oil sumps. Lubrication of critical engine parts includes piston rings, cylinder liners, bearings, piston cooling, fuel pump, engine control hydraulics, etc. Fuel is typically the major cost of operating these engines and a typical 12 cylinder, 90 cm bore low-speed diesel engine used in marine vessel container service will burn up to approximately $33M of heavy fuel per year at today's price of $480/MT. Therefore, a fuel efficiency gain of as little as 1% would result in approximately up to $330k annual savings to the ship operator. In addition, governmental organizations, such as the International Marine Organization, U.S. Environmental Protection Agency and the California Air Resources Board are legislating emissions requirements for these engines Improving fuel efficiency will reduce emissions ($CO_2$, $SO_x$, $NO_x$ and Particulate Matter) commensurately which should result in some emissions credit trading value.

In addition to providing adequate oil film thickness to prevent metal-to-metal contact, lubricants for these engines are designed to cope with a variety of other stresses, including neutralizing acids formed by the combustion of fuels containing sulfur to minimize corrosive wear of the piston rings and cylinder liner, minimizing engine deposits formed by fuel combustion and by contamination of the lubricant with raw or partially burned fuel, resisting thermal/oxidation degradation of the lubricant due to the extreme heat in these engines, transferring heat away from the engine, etc.

A long term requirement is that the lubricant must maintain cleanliness within the high temperature environment of the engine, especially for critical components such as the piston and piston rings. Contamination of the engine oil in the engine by the accumulation in it of raw and partially burned fuel combustion products, water, soot as well as the thermal/oxidation degradation of the oil itself can degrade the engine cleanliness performance of the engine oil. Therefore, it is desirable for engine oils to be formulated to have good cleanliness qualities and to resist degradation of those qualities due to contamination and thermal/oxidative degradation.

U.S. Pat. No. 6,339,051 is directed to diesel engine cylinder oils for use in marine and stationary slow speed diesel engines. The cylinder oils are based on medium KV at 100° C. of about 12 $mm^2/s$ and less heavy Group I or Group II neutral base oils (300 to 500 SUS) in combination with liquid, oil miscible polyisobutylene and further containing an additive package comprising a detergent component or components, an anti-oxidant, an anti-wear agent and a dispersant. The detergent comprises one or more overbased phenates, phenylates, salicylates or sulfonates. The oil composition has a kinematic viscosity range of 15 to 25 $mm^2/s$ (100° C.), more usually nominally 18.5 to 21.9 $mm^2/s$ or 21.96 to 26.1 $mm^2/s$ (100° C.). The oil formulation has a Total Base Number in the range 40 to 100.

Gas engine oils of enhanced life as evidenced by an increase in the resistance of the oil to oxidation, nitration and deposit formation are the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one alkali or alkaline earth metal salt having a Total Base Number (TBN) of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti-oxidants (about 0.05 to 1.5 vol %), metal deactivators such as triazoles, alkyl-substituted dimercaptothiadiazoles (about 0.01 to 0.2 vol %), anti-wear additives such as metal dithiophosphates, metal dithiocarbamates, metal xanthates or tricresylphosphates (about 0.05 to 1.5 vol %), pour point depressants such as poly (meth) acrylates or alkyl aromatic polymers (about 0.05-0.6 vol %), anti-foamants such as silicone anti-foaming agents (about 0.005 to 0.15 vol %) and viscosity index improvers, such as olefin copolymers, polymethacrylates, styrene-diene block copolymers, and star copolymers (up to about 15 vol %, preferably up to about 10 vol %).

U.S. Pat. No. 6,191,081 is directed to a lubricating oil composition for natural gas engines comprising a major amount of a base oil of lubricating viscosity and a minor amount of a mixture of one or more metal salicylate detergents and one or more metal phenate(s) and/or metal sulfonate detergents.

The lubricating oil base stock is any natural or synthetic lubricating base oil stock fraction typically having a kinematic viscosity at 100° C. of about 5 to 20 cSt. In a preferred embodiment, the use of the viscosity index improver permits the omission of oil of viscosity about 20 cSt or more at 100° C. from the lube base oil fraction used to make the present formulation. Therefore, a preferred base oil is one which contains little, if any, heavy fraction; e.g., little, if any, lube oil fraction of viscosity 20 cSt or higher at 100° C.

The lubricating oil base stock can be derived from natural lubricating oils, synthetic lubricating oils or mixtures thereof. Suitable lubricating oil base stocks include base stocks obtained by isomerization of synthetic wax and slack wax, as well as hydrocrackate base stocks produced by hydrocracking (rather than solvent extracting) the aromatic and polar components of the crude. Suitable base stocks include those in API categories I, II and III, where saturates level and Viscosity Index are:

Group I—less than 90% and 80-120, respectively;

Group II—greater than 90% and 80-120, respectively; and

Group III—greater than 90% and greater than 120, respectively.

The mixture of detergents comprises a first metal salt or group of metal salts selected from the group consisting of one or more metal sulfonates(s), salicylate(s), phenate(s) and mixtures thereof having a high TBN of greater than about 150 to 300 or higher, used in an amount in combination with the other metal salts or groups of metal salts (recited below) sufficient to achieve a lubricating oil of at least 0.65 wt % sulfated ash content, a second metal salt or group of metal salts selected from the group consisting of one or more metal salicylate(s), metal sulfonate(s), metal phenate(s) and mixtures thereof having a medium TBN of greater than about 50 to 150, and a third metal salt or group of metal salts selected from the group consisting of one or more metal sulfonate(s), metal salicylate(s) and mixtures thereof identified as neutral or low TBN, having a TBN of about 10 to 50, the total amount of medium plus neutral/low TBN detergent being about 0.7 vol % or higher (active ingredient), wherein at least one of the medium or low/neutral TBN detergent(s) is metal salicylate, preferably at least one of the medium TBN detergent(s) is a metal salicylate. The total amount of high TBN detergents is about 0.3 vol % or higher (active ingredient). The mixture contains salts of at least two different types, with medium or neutral salicylate being an essential component. The volume ratio (based on active ingredient) of the high TBN detergent to medium plus neutral/low TBN detergent is in the range of about 0.15 to 3.5.

The mixture of detergents is added to the lubricating oil formulation in an amount up to about 10 vol % based on active ingredient in the detergent mixture, preferably in an amount up to about 8 vol % based on active ingredient, more preferably 6 vol % based on active ingredient in the detergent mixture, most preferably between about 1.5 to 5.0 vol %, based on active ingredient in the detergent mixture. Preferably, the total amount of metal salicylate(s) used of all TBNs is in the range of between 0.5 vol % to 4.5 vol %, based on active ingredient of metal salicylate.

U.S. Published Application US2005/0059563 is directed to a lubricating oil composition, automotive gear lubricating composition and fluids useful in the preparation of finished automotive gear lubricants and gear oil comprising a blend of a PAO having a viscosity of between about 40 cSt ($mm^2/s$) and 1000 cSt ($mm^2/s$) @ 100° C., and an ester having a viscosity of less than or equal to about 2.0 cSt ($mm^2/s$) @ 100° C. wherein the blend of PAO and ester has a viscosity index greater than or equal to the viscosity index of the PAO. The composition may further contain thickeners, anti-oxidants, inhibitor packages, anti-rust additives, dispersants, detergents, friction modifiers, traction improving additives, demulsifiers, defoamants, dyes and haze inhibitors.

U.S. Published Application US2003/0191032 is directed to a detergent additive for lubricating oil compositions comprising at least two of low, medium and high TBN detergents, preferably a calcium salicylate. The detergent is in a lubricating oil composition comprising at least one of Group II base stock, Group III base stock or wax isomerate base stock and mixtures thereof, and an optional minor quantity of a co-base stock(s). Co-base stocks include polyalpha olefin oligomeric low and medium and high viscosity oil, di-basic acid esters, polyol esters, other hydrocarbon oils, supplementary hydrocarbyl aromatics and the like.

US Published Application 2006/0276355 is directed to a lubricant blend for enhanced micropitting properties wherein the lubricant comprises at least two base stocks with a viscosity difference between the first and second base stock of greater than 96 $mm^2/s$ @ 100° C. At least one base stock is a polyalpha olefin with a viscosity of less than 6 $mm^2/s$ but greater than 2 $mm^2/s$, and the second base stock is a synthetic oil with a viscosity greater than 100 ($mm^2/s$) but less than 300 $mm^2/s$ @ 100° C. The second base stock can be a high viscosity polyalpha olefin.

U.S. Published Application 2007/0289897 is directed to a lubricating oil blend comprising at least two base stocks with a viscosity difference between the first and second base stock of greater than 96 cSt $mm^2/s$ @ 100° C., the lubricant exhibiting improved air release. The blend contains at least one synthetic PAO having a viscosity of less than 10 cSt $mm^2/s$ but greater than 2 cSt $mm^2/s$ @ 100° C. and a second synthetic oil having a viscosity greater than 100 cSt ($mm^2/s$) but less than 300 cSt ($mm^2/s$) @ 100° C. The lubricant can contain anti-wear, anti-oxidant, defoamant, demulsifier, detergent, dispersant, metal passivator, friction reducer, rust inhibitor additive and mixtures thereof.

U.S. Published Application 2007/0298990 is directed to a lubricating oil comprising at least two base stocks, the first base stock has a viscosity greater than 40 cSt ($mm^2/s$) @ 100° C. and a molecular weight distribution (MWD) as a function of viscosity at least 10% less than algorithm:

$$MWD=0.2223+1.0232*\log(Kv \text{ at } 100^\circ \text{ C. in cSt})$$

and a second base stock with a viscosity less than 10 cSt ($mm^2/s$) @ 100° C. Preferably the difference in viscosity between the first and second stocks is greater than 30 cSt ($mm^2/s$) @ 100° C. Preferably the high viscosity first stock is a metallocene catalyzed PAO base stock. The second stock can be selected from GTL lubricants, wax-derived lubricants, PAO, brightstock, brightstock with PIB, Group I base stocks, Group II base stocks, Group III base stocks and mixtures thereof. The lubricant can contain additives including detergents. Preferably the first stock has a viscosity of greater than 300 cSt ($mm^2/s$) @ 100° C., the second stock has a viscosity of between 1.5 cSt ($mm^2/s$) to 6 cSt ($mm^2/s$) @ 100° C. Preferably the difference in viscosity between the first and second stocks is greater than 96 cSt ($mm^2/s$) @ 100° C.

U.S. Published Application US2008/0207475 is directed to a lubricating oil comprising at least two base stocks, the first base stock having a viscosity of at least 300 cSt ($mm^2/s$) @ 100° C. and a molecular weight distribution (MSD) as a function of viscosity at least 10% less than algorithm:

$$MWD=0.2223+1.0232*\log(KV \text{ @ } 100^\circ \text{ C. in cSt})$$

and the second stock has a viscosity of less than 100 cSt ($mm^2/s$) @ 100° C. Preferably the difference in viscosity between the first and second stocks is greater than 250 cSt ($mm^2/s$) @ 100° C. Preferably the first stock is a metallocene catalyzed PAO base stock. The second stock can be chosen from GTL base stock, wax-derived base stock, PAO, brightstock, brightstock with PIB, Group I base stock, Group II base stock, Group III base stock, Group V base stock, Group VI base stock and mixtures thereof. The lubricant can contain additives including detergents.

U.S. Pat. No. 6,140,281 is directed to long life gas engine lubricating oils containing detergents. The lubricating oil comprises a major amount of a base oil of lubricating viscosity and a minor amount of a mixture of one or more metal sulfonate(s) and/or phenate(s) and one or more metal salicylate(s) detergents, all detergents in the mixture having the same or substantially the same Total Base Number (TBN).

The lubricating oil base stock is any natural or synthetic lubricating base stock fraction typically having a kinematic viscosity at 100° C. of about 5 to 20 cSt. In a preferred embodiment, the use of the viscosity index improver permits the omission of oil of viscosity 20 cSt or more at 100° C. from the lube base oil fraction used to make the present formulation. Therefore, a preferred base oil is one which contains little, if any, heavy fractions; e.g., little, if any, lube oil fraction of viscosity 20 cSt or higher at 100° C.

The lubricating oil base stock can be derived from natural lubricating oils, synthetic lubricating oils or mixtures thereof. Suitable base stocks include those in API categories I, II and III, where saturates level and Viscosity Index are:

Group I—less than 90% and 8-120, respectively;

Group II—greater than 90% and 80-120, respectively; and

Group III—greater than 90% and greater than 120, respectively.

Suitable lubricating oil base stocks include base stocks obtained by isomerization of synthetic wax and slack wax, as well as hydrocrackate base stocks produced by hydrocracking (rather than solvent extracting) the aromatic and polar components of the crude.

The detergent is a mixture of one or more metal sulfonate(s) and/or metal phenate(s) with one or more metal salicylate(s). The metals are any alkali or alkaline earth metals; e.g., calcium, barium, sodium, lithium, potassium, magnesium, more preferably calcium, barium and magnesium. It is a feature of the lubricating oil that each of the metal salts used in the mixture has the same or substantially the same TBN as the other metal salts in the mixture.

The TBNs of the salts will differ by no more than about 15%, preferably no more than about 12%, more preferably no more than about 10% or less.

The one or more metal sulfonate(s) and/or metal phenate(s), and the one or more metal salicylate(s) are utilized in the detergent as a mixture, for example, in a ratio by parts of 5:95 to 95:5, preferably 10:90 to 90:10, more preferably 20:80 to 80:20.

The mixture of detergents is added to the lubricating oil formulation in an amount up to about 10 vol % based on active ingredient in the detergent mixture, preferably in an amount up to about 8 vol % based on active ingredient.

U.S. Pat. No. 6,645,922 is directed to a lubricating oil for two-stroke cross-head marine diesel engines comprising a base oil and an oil-soluble overbased detergent additive in the form of a complex wherein the basic material of the detergent is stabilized by more than one surfactant. The more than one surfactants can be mixtures of: (1) sulfurized and/or non-sulfurized phenols and one other surfactant which is not a phenol surfactant; (2) sulfurized and/or non-sulfurized salicylic acid and one other surfactant which is not a salicylic surfactant; or (3) at least three surfactants which are sulfurized or non-sulfurized phenol, sulfurized or non-sulfurized salicylic acid and one other surfactant which is not a phenol or salicylic surfactant; or (4) at least three surfactants which are sulfurized or non-sulfurized phenol, sulfurized or non-sulfurized salicylic acid and at least one sulfuric acid surfactant.

The base stock is an oil of lubricating viscosity and may be any oil suitable for the system lubrication of a cross-head engine. The lubricating oil may suitably be an animal, vegetable or a mineral oil. Suitably the lubricating oil is a petroleum-derived lubricating oil, such as naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example, liquid polyisobutene and polyalpha olefins. Commonly, a mineral oil is employed. The lubricating oil may generally comprise greater than 60, typically greater than 70% by mass of the lubricating oil composition and typically have a kinematic viscosity at 100° C. of from 2 to 40, for example, from 3 to 15 $mm^2/s$, and a viscosity index from 80 to 100, for example, from 90 to 95.

Another class of lubricating oil is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example, from 3 to 15 $mm^2/s$, and a viscosity index typically in the range of from 100 to 110, for example, from 105 to 108.

Brightstock refers to base oils which are solvent-extracted, de-asphalted products from vacuum residuum generally having a kinematic viscosity at 100° C. from 28 to 36 $mm^2/s$, and are typically used in a proportion of less than 30, preferably less than 20, more preferably less than 15, most preferably less than 10, such as less than 5 mass %, based on the mass of the lubricating oil composition.

U.S. Pat. No. 6,613,724 is directed to gas fueled engine lubricating oil comprising an oil of lubricating viscosity, a detergent including at least one calcium salicylate having a TBN in the range 70 to 245, 0 to 0.2 mass % of nitrogen, based on the mass of the oil composition, of a dispersant and minor amounts of one or more co-additive. The base oil can be any animal, vegetable or mineral oil or synthetic oil. The base oil is used in a proportion of greater than 60 mass % of the composition. The oil typically has a viscosity at 100° C. of from 2 to 40, for example 3 to 15 $mm^2/s$ and a viscosity index of from 80 to 100. Hydrocracked oils can also be used which have viscosities of 2 to 40 $mm^2/s$ at 100° C. and viscosity indices of 100 to 110. Brightstock having a viscosity at 100° C. of from 28 to 36 $mm^2/s$ can also be used, typically in a proportion less than 30, preferably less than 20, most preferably less than 5 mass %.

U.S. Pat. No. 7,101,830 is directed to a gas engine oil having a boron content of more than 95 ppm comprising a major amount of a lubricating oil having a viscosity index of 80 to 120, at least 90 mass % saturates, 0.03 mass % or less sulfur and at least one detergent. Metal salicylate is a preferred detergent.

U.S. Pat. No. 4,956,122 is directed to a lubricating oil composition containing a high viscosity synthetic hydrocarbon such as high viscosity PAO, liquid hydrogenated polyisoprenes, or ethylene-alpha olefin copolymers having a viscosity of 40-1000 cSt ($mm^2/s$) at 100° C., a low viscosity synthetic hydrocarbon having a viscosity of between 1 and 10 cSt ($mm^2/s$) at 100° C., optionally a low viscosity ester having a viscosity of between 1 and 10 cSt ($mm^2/s$) at 100° C. and optionally up to 25 wt % of an additive package.

DESCRIPTION OF THE FIGURE

FIG. 1 presents the effect on traction coefficient at different speeds of an engine oil comprising Group IV base stock (PAO 150) and a Group I base oil in combination with a mixture of salicylate and phenate detergents relative to three reference oils.

DESCRIPTION OF THE INVENTION

The present invention is directed to a method for improving the fuel economy of large low and medium speed engines in which the interfacing surface speeds reach at least about 3 mm/s, preferably at least 60 mm/s, more preferably at least 70 mm/s, by reducing the traction coefficient of the engine oil used to lubricate the engine. This is achieved by employing as the engine oil a lubricating oil having a kinematic viscosity at 100° C. of 25 $mm^2/s$ or less, the lubricating oil comprising a base oil comprised of a bimodal blend of two different base oils, the first base oil being one or more oils selected from the group consisting of Group I base oils having a kinematic viscosity at 100° C. of from 2 to less than 12 $mm^2/s$, preferably 2 to 8 $mm^2/s$, more preferably 2 to 4 $mm^2/s$, and a second base oil selected from one or more oils selected from Group IV base oils having a kinematic viscosity at 100° C. of at least 38 $mm^2/s$, the difference in kinematic viscosity between the first and second base oils being at least 30 $mm^2/s$, and containing 1 to 30 wt % based on active ingredient of one or more alkali and/or alkaline earth metal, preferably alkaline earth metal, more preferably calcium, detergents, wherein the improvement in the fuel economy is evidenced by the engine oil having a coefficient of friction which is lower than the coefficient of friction as compared to engine oils which are not bimodal or which are based on Group I base stocks or a mixture of Group I base stock and PIB. As employed herein and in the appended claims, the terms "base stock" and "base oil" are used synonymously and interchangeably.

The present invention is also directed to a method for improving the fuel economy of large low and medium speed engines that reach surface speeds of at least 3 mm/s, preferably at least 60 mm/s, more preferably at least 70 mm/s, and are lubricated by an engine oil by reducing the traction coefficient of the engine oil used to lubricate the engine, by employing as the engine oil a lubricating oil having a kinematic viscosity at 100° C. of 25 $mm^2/s$ or less comprising a first base oil selected from Group I base oils having a kinematic viscosity at 100° C. of from 2 to less than 12 $mm^2/s$, preferably 2 to 8 $mm^2/s$, more preferably 2 to 4 $mm^2/s$, and a second base oil selected from Group IV base oils having a kinematic viscosity at 100° C. of at least 38 $mm^2/s$, the difference in kinematic viscosity between the first and second base oils being at least 30 $mm^2/s$, and containing one or more alkali and/or alkaline earth metal, preferably alkaline earth metal, more preferably calcium, detergents selected from the group consisting of alkali and/or alkaline earth metal sulfonate, phenate, salicylate or carboxylate in an amount in the range of 1 to 30 wt % based on active ingredient, wherein the improvement in the fuel economy is evidenced by the engine oil having a traction coefficient which is lower than the traction coefficient of an engine oil of the same kinematic viscosity at 100° C. comprising a single base oil component of a Group I base oil or a blend of Group I base oil and Group IV base oil having a difference in kinematic viscosity of less than 30 $mm^2/s$, or which are based on mixtures of Group I base oils and PIB.

Preferably the difference in viscosity between the first and second base stocks is at least 36 $mm^2/s$, more preferably at least 90 $mm^2/s$, still more preferably at least 140 $mm^2/s$.

The lubricating oil preferably has a kinematic viscosity at 100° C. of about 25 $mm^2/s$ or less, more preferably 20 $mm^2/s$ or less.

By "surface speed" is meant the velocity at which interfacing surfaces in the engine, e.g. cylinder wall and piston or interfacing surfaces of bearings move past each other as the engine operates. This surface speed is a primary factor in influencing whether the lubrication regime for the interfacing surfaces is boundary, hydrodynamic or mixed (boundary/hydrodynamic).

The method of the present invention utilizes a bimodal mixture of base stocks. By bimodal in the present specification is meant a mixture of at least two base stocks each having a different kinematic viscosity at 100° C. wherein the difference in kinematic viscosity @ 100° C. between the at least two base stocks is at least 30 $mm^2/s$. The mixture of at least two base stocks comprises one or more low kinematic viscosity base stock(s) having a kinematic viscosity at 100° C. of from 2 to less than 12 $mm^2/s$, which base stock is selected from the group consisting of Group I base stocks in combination with one or more high kinematic viscosity Group IV base stocks having a kinematic viscosity at 100° C. of at least 38 $mm^2/s$.

As employed herein and in the appended claims, the terms "base stock" and "base oil" are used synonymously and interchangeably.

Group I base stocks are classified by the American Petroleum Institute (API Publication 1509, www.API.org) as oils containing greater than about 0.03% sulfur, less than about 90% saturates and having a viscosity index of between 80 to less than 120.

The low kinematic viscosity fluid can be employed as a single component oil or as a mixture of oils provided the single oil or mixture of oils has a low kinematic viscosity in the range of 2 to less than 12 $mm^2/s$ at 100° C.

Thus, the low kinematic viscosity fluid can constitute a single base stock/oil meeting the recited kinematic viscosity or it can be made up of two or more base stocks/oils, each individually meeting the recited kinematic viscosity limits. Further, the low kinematic viscosity fluid can be made up of mixtures of one, two or more low viscosity oil stocks, e.g. stocks/oils with kinematic viscosities in the range of 2 to less than 12 $mm^2/s$ at 100° C. combined with one, two or more high kinematic viscosity stocks/oils, e.g. stocks/oils with kinematic viscosities greater than 12 $mm^2/s$ at 100° C., such as stocks/oils with kinematic viscosities at 100 $mm^2/s$ or greater at 100° C., provided that the resulting mixture blend exhibits the target low kinematic viscosity of 2 to less than 12 $mm^2/s$ at 100° C. recited as the viscosity range of the first low kinematic viscosity stock.

The second component in the bimodal blend is a high kinematic viscosity Group IV fluid (i.e., PAO) with a kinematic viscosity at 100° C. of at least 38 $mm^2/s$.

The polyalpha olefins (PAOs) in general are typically comprised of relatively low molecular weight hydrogenated polymers or oligomers of polyalphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins.

The PAO fluids may be conveniently made by the polymerization of an alphaolefin in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The PAOs useful in the present invention can also be made by metallocene catalysis. The metallocene-catalyzed PAO (mPAO) can be a copolymer made from at least two alphaolefins or more, or a homo-polymer made from a single alphaolefin feed by a metallocene catalyst system.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2009/123800, WO 2007/011832 and published U.S. application U.S. 2009/0036725.

The copolymer mPAO composition is made from at least two alphaolefins of $C_3$ to $C_{30}$ range and having monomers randomly distributed in the polymers. It is preferred that the average carbon number is at least 4.1, advantageously, ethylene and propylene, if present in the feed, are present in the amount of less than 50 wt % individually or preferably less than 50 wt % combined. The copolymers of the invention can be isotactic, atactic, syndiotactic polymers or any other form of appropriate taciticity. These copolymers have narrow molecular weight distributions and excellent lubricating properties.

mPAO can also be made from mixed feed Linear Alpha Olefins (LAOs) comprising at least two and up to 26 different linear alphaolefins selected from $C_3$ to $C_{30}$ linear alphaolefins. In a preferred embodiment, the mixed feed LAO is obtained from an ethylene growth processing using an aluminum catalyst or a metallocene catalyst. The growth olefins comprise mostly $C_6$ to $C_{18}$ LAO. LAOs from other processes can also be used.

The homo-polymer mPAO composition is made from single alphaolefin choosing from $C_3$ to $C_{30}$ range, preferably $C_3$ to $C_{16}$, most preferably $C_3$ to $C_{14}$ or $C_3$ to $C_{12}$. The homo-polymers can be isotactic, atactic, syndiotactic polymers or any other form of appropriate taciticity. Often the taciticity can be carefully tailored by the polymerization catalyst and polymerization reaction condition chosen or by the hydrogenation condition chosen. These homo-polymers have useful lubricant properties including excellent VI, pour point, low temperature viscometrics by themselves or as a blend fluid with other lubricants or other polymers. Furthermore, these homo-polymers have narrow molecular weight distributions and excellent lubricating properties.

In another embodiment, the alphaolefin(s) can be chosen from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. In another embodiment, the alphaolefins can be chosen from the alphaolefins produced from Fischer-Tropsch synthesis (as reported in U.S. Pat. No. 5,382,739). For example, $C_3$ to $C_{16}$ alphaolefins, more preferably linear alphaolefins, are suitable to make homo-polymers. Other combinations, such as $C_4$- and $C_{14}$-LAO, $C_6$- and $C_{16}$-LAO, $C_8$-, $C_{10}$-, $C_{12}$-LAO, or $C_8$- and $C_{14}$-LAO, $C_6$-, $C_{10}$-, $C_{14}$-LAO, $C_4$- and $C_{12}$-LAO, etc., are suitable to make copolymers.

A feed comprising a mixture of LAOs selected from $C_3$ to $C_{30}$ LAOs or a single LAO selected from $C_3$ to $C_{16}$ LAO, is contacted with an activated metallocene catalyst under oligomerization conditions to provide a liquid product suitable for use in lubricant components or as functional fluids. This invention is also directed to a copolymer composition made from at least two alphaolefins of $C_3$ to $C_{30}$ range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure.

One process for producing mPAO employs a catalyst system comprising a metallocene compound (Formula 1, below) together with an activator such as a non-coordinating anion (NCA) (Formula 2, below) or methylaluminoxane (MAO) 1111 (Formula 3, below):

Formula 1

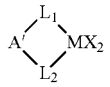

Formula 2

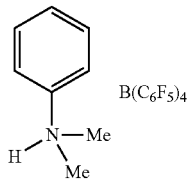

NCA

Formula 3

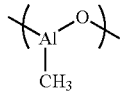

MAO

The term "catalyst system" is defined herein to mean a catalyst precursor/activator pair, such as a metallocene/activator pair. When "catalyst system" is used to describe such a pair before activation, it means the unactivated catalyst (pre-catalyst) together with an activator and, optionally, a co-activator (such as a trialkyl aluminum compound). When it is used to describe such a pair after activation, it means the activated catalyst and the activator or other charge-balancing moiety. Furthermore, this activated "catalyst system" may optionally comprise the co-activator and/or other charge-balancing moiety. Optionally and often, the co-activator, such as trialkyl aluminum compound, is also used as an impurity scavenger.

The metallocene is selected from one or more compounds according to Formula 1 above. In Formula 1, M is selected from Group 4 transition metals, preferably zirconium (Zr), hafnium (Hf) and titanium (Ti), L1 and L2 are independently selected from cyclopentadienyl ("Cp"), indenyl, and fluorenyl, which may be substituted or unsubstituted, and which may be partially hydrogenated. A is an optional bridging group which, if present, in preferred embodiments is selected from dialkylsilyl, dialkylmethyl, diphenylsilyl or diphenylmethyl, ethylenyl ($—CH_2—CH_2$), alkylethylenyl ($—CR_2—CR_2$), where alkyl can be independently $C_1$ to $C_{16}$ alkyl radical or phenyl, tolyl, xylyl radical and the like, and wherein each of the two X groups, Xa and Xb, are independently selected from halides OR(R is an alkyl group, preferably selected from $C_1$ to $C_5$ straight or branched chain alkyl groups), hydrogen, $C_1$ to $C_{16}$ alkyl or aryl groups, haloalkyl, and the like. Usually relatively more highly substituted metallocenes give higher catalyst productivity and wider product viscosity ranges and are thus often more preferred.

The polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

The m-polyalphaolefins (mPAO) described herein may have monomer units represented by Formula 4 in addition to the all regular 1,2-connection:

Formula 4

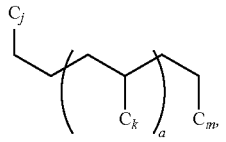

where j, k and m are each, independently, 3, 4, 5, 6, 7, 8, 9, 10, 11, 12, 13, 14, 15, 16, 17, 18, 19, 20, 21 or 22, n is an integer from 1 to 350 (preferably 1 to 300, preferably 5 to 50) as measured by proton NMR.

Any of the m-polyalphaolefins (mPAO) described herein preferably have an Mw (weight average molecular weight) of 100,000 or less, preferably between 100 and 80,000, preferably between 250 and 60,000, preferably between 280 and 50,000, preferably between 336 and 40,000 g/mol.

Any of the m-polyalphaolefins (mPAO) described herein preferably have a Mn (number average molecular weight) of 50,000 or less, preferably between 200 and 40,000, preferably between 250 and 30,000, preferably between 500 and 20,000 g/mol.

Any of the m-polyalphaolefins (mPAO) described herein preferably have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein preferably have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternatively, the amount of the mPAO that has a molecular weight greater than 45,000 Daltons is not more than 1.5 wt %, or not more than 0.10 wt %. Additionally or alternatively, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

Any mPAO described herein may have a pour point of less than 0° C. (as measured by ASTM D97), preferably less than −10° C., preferably less than 20° C., preferably less than −25° C., preferably less than −30° C., preferably less than −35° C., preferably less than −50° C., preferably between −10° C. and −80° C., preferably between −15° C. and −70° C.

m-Polyalphaolefins (mPAO) made using metallocene catalysis may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445.

Other PAOs useful in the present invention include those made by the process disclosed in U.S. Pat. No. 4,827,064 and U.S. Pat. No. 4,827,073. Those PAO materials, which are produced by the use of a reduced valence state chromium catalyst, are olefin oligomers of polymers which are characterized by very high viscosity indices which give them very desirable properties to be useful as lubricant base stocks and, with higher viscosity grades, as VI improvers. They are referred to as High Viscosity Index PAOs or HVI-PAOs. The relatively low molecular weight high viscosity PAO materials were found to be useful as lubricant base stocks whereas the higher viscosity PAOs, typically with viscosities of 100 cSt or more, e.g. in the range of 100 to 1,000 cSt, were found to be very effective as viscosity index improvers for conventional PAOs and other synthetic and mineral oil derived base stocks Various modifications and variations of these high viscosity PAO materials are also described in the following U.S. patents to which reference is made: U.S. Pat. Nos. 4,990,709; 5,254,274; 5,132,478; 4,912,272; 5,264,642; 5,243,114; 5,208,403; 5,057,235; 5,104,579; 4,943,383; 4,906,799. These oligomers can be briefly summarized as being produced by the oligomerization of 1-olefins in the presence of a metal oligomerization catalyst which is a supported metal in a reduced valence state. The preferred catalyst comprises a reduced valence state chromium on a silica support, prepared by the reduction of chromium using carbon monoxide as the reducing agent. The oligomerization is carried out at a temperature selected according to the viscosity desired for the resulting oligomer, as described in U.S. Pat. Nos. 4,827,064 and 4,827,073. Higher viscosity materials may be produced as described in U.S. Pat. No. 5,012,020 and U.S. Pat. No. 5,146,021 where oligomerization temperatures below about 90° C. are used to produce the higher molecular weight oligomers. In all cases, the oligomers, after hydrogenation when necessary to reduce residual unsaturation, have a branching index (as defined in U.S. Pat. Nos. 4,827,064 and 4,827,073) of less than 0.19. Overall, the HVI-PAO normally have a viscosity in the range of about 12 to 5,000 cSt.

Furthermore, the HVI-PAOs generally can be characterized by one or more of the following: $C_{30}$ to $C_{1300}$ hydrocarbons having a branch ratio of less than 0.19, a weight average molecular weight of between 300 and 45,000, a number average molecular weight of between 300 and 18,000, a molecular weight distribution of between 1 and 5. Particularly preferred HVI-PAOs are fluids with 100° C. viscosity ranging from 3 to 5000 $mm^2/s$ or more. The fluids with viscosity at 100° C. of 3 $mm^2/s$ to 5000 $mm^2/s$ have VI calculated by ASTM method D2270 greater than 130. Usually they range from 130 to 350. The fluids all have low pour points, below −15° C.

The HVI-PAOs can further be characterized as hydrocarbon compositions comprising the polymers or oligomers made from 1-alkenes, either by itself or in a mixture form, taken from the group consisting of $C_6$ to $C_{20}$ 1-alkenes. Examples of the feeds can be 1-hexene, 1-octene, 1-decene, 1-dodecene, 1-tetradecene, etc. or mixture of $C_6$ to $C_{14}$ 1-alkenes or mixture of $C_6$ to $C_{20}$ 1-alkenes, $C_6$ and $C_{12}$ 1-alkenes, $C_6$ and $C_{14}$ 1-alkenes, $C_6$ and $C_{16}$ 1-alkenes, $C_6$ and $C_{18}$ 1-alkenes, $C_8$ and $C_{10}$ 1-alkenes, $C_8$ and $C_{12}$ 1-alkenes, $C_8$, $C_{10}$ and $C_{12}$ 1-alkenes, and other appropriate combinations.

The products usually are distilled to remove any low molecular weight compositions such as those boiling below 600° F., or with carbon numbers less than $C_{20}$, if they are produced from the polymerization reaction or are carried over from the starting material. This distillation step usually improves the volatility of the finished fluids.

The fluids made directly from the polymerization or oligomerization process usually have unsaturated double bonds or have olefinic molecular structure. The amount of double bonds or unsaturation or olefinic components can be measured by several methods, such as bromine number (ASTM D1159), bromine index (ASTM D2710) or other suitable analytical methods, such as NMR, IR, etc. The amount of the double bond or the amount of olefinic compositions depends on several factors—the degree of polymerization, the amount of hydrogen present during the polymerization process and the amount of other promoters which anticipate in the termination steps of the polymerization process, or other agents present in the process. Usually the amount of double bonds or the amount of olefinic components is decreased by the higher degree of polymerization, the higher amount of hydrogen gas present in the polymerization process or the higher amount of promoters participating in the termination steps.

It is known that, usually, the oxidative stability and light or UV stability of fluids improves when the amount of unsaturation double bonds or olefinic contents is reduced. Therefore, it is desirable to further hydrotreat the polymer if it has a high degree of unsaturation. Usually the fluids with bromine number of less than 5, as measured by ASTM D1159, is suitable for high quality base stock application. Of course, the lower the bromine number, the better the lube quality. Fluids with bromine numbers of less than 3 or 2 are common. The most preferred range is less than 1 or less than 0.1. The method to hydrotreat to reduce the degree of unsaturation is well known in literature (U.S. Pat. No. 4,827,073, example 16). In some HVI-PAO products, the fluids made directly from the polymerization already have very low degree of unsaturation, such as those with viscosities greater than 150 cSt at 100° C. They have bromine numbers less than 5 or even below 2. In these cases, it can be used as is without hydrotreating, or it can be hydrotreated to further improve the base stock properties.

The high kinematic viscosity PAO fluid which is the second fluid of the bimodal mixture is made employing metallocene catalysis or the process described in U.S. Pat. No. 4,827,064 or U.S. Pat. No. 4,827,073 or any other PAO synthesis process capable of producing PAO having a kinematic viscosity at 100° C. of at least 38 $mm^2/s$.

Regardless of the technique or process employed to make PAO, the PAO fluid used as the second base stock of the bimodal blend is a high kinematic viscosity PAO having a KV at 100° C. of at least 38 $mm^2/s$, preferably about 38 to 1200 $mm^2/s$, more preferably about 38 to 600 $mm^2/s$.

In regard to this second, high kinematic viscosity PAO oil, it can be made up of a single component PAO base stock/oil meeting the recited kinematic viscosity limits or it may be made up of two or more PAO base stocks/oils, each of which meet the recited kinematic viscosity limits. Conversely, this second high kinematic viscosity PAO oil can be a mixture of one, two or more lower kinematic viscosity PAO base stock oils, e.g., stock with kinematic viscosities of less than 38 $mm^2/s$ at 100° C. in combination with one, two or more high kinematic viscosity PAO base stock oils provided that the resulting mixture blend meets the target high kinematic viscosity of at least 38 $mm^2/s$ at 100° C.

The present invention achieves its reduction in traction coefficient by use of a lubricant comprising a bimodal blend of two different base oils, the first being one or more Group I base oils having a KV at 100° C. of from 2 to less than 12 $mm^2/s$ and the second being one or more Group IV base oils having a KV at 100° C. of at least 38 $mm^2/s$, preferably 38 to 1200 $mm^2/s$, more preferably 38 to 600 $mm^2/s$, provided there is a difference in KV between the first and second base stock of at least 30 $mm^2/s$ and the blend has a KV at 100° C. of 25 $mm^2/s$ or less, preferably 20 $mm^2/s$ or less in combination with one or more of an alkali or alkaline earth metal, preferably alkaline earth metal, more preferably calcium, detergent of sulfonate, phenate, salicylate, carboxylate, preferably phenate and salicylate, more preferably a mixture of phenate and salicylate. The detergent need not be the salt of a single metal but can be a mixture of metal salts, e.g. a mixture of sodium salt and/or lithium salt and/or calcium salt and/or magnesium salt, only by way of example and not limitation. The detergent is present in an amount in the range 1 to 30 wt %, preferably greater than 6 to 30 wt %, more preferably 12 to 30 wt %, on an active ingredient basis. The preferred detergent is a mixture of phenate and salicylate wherein the components are present in a weight ratio (active ingredient) in the range 1:10 to 10:1, preferably 3:1 to 1:3.

The method can use the engine lubricating oil described above further containing additional performance additives provided the base stock comprises the essential bimodal blend base stock and detergent, preferably mixed phenate/salicylate detergent.

The formulated lubricating oil useful in the present invention may additionally contain one or more of the other commonly used lubricating oil performance additives including but not limited to dispersants, other detergents, corrosion inhibitors, rust inhibitors, metal deactivators, other anti-wear and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the present invention in lubricant compositions are not limited by the examples shown herein as illustrations.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 1,000 to 1,000,000, more typically about 2,000 to 500,000, and even more typically between about 2,500 and 200,000.

Examples of suitable viscosity improvers are polymers and copolymers of methacrylate, butadiene, olefins, or alkylated styrenes. Polyisobutylene is a commonly used viscosity improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 10 wt %, preferably zero to 6 wt %, more preferably zero to 4 wt % based on active ingredient and depending on the specific viscosity modifier used.

Anti-Oxidants

Typical anti-oxidant include phenolic anti-oxidants, aminic anti-oxidants and oil-soluble copper complexes.

The phenolic anti-oxidants include sulfurized and non-sulfurized phenolic anti-oxidants. The terms "phenolic type" or "phenolic anti-oxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

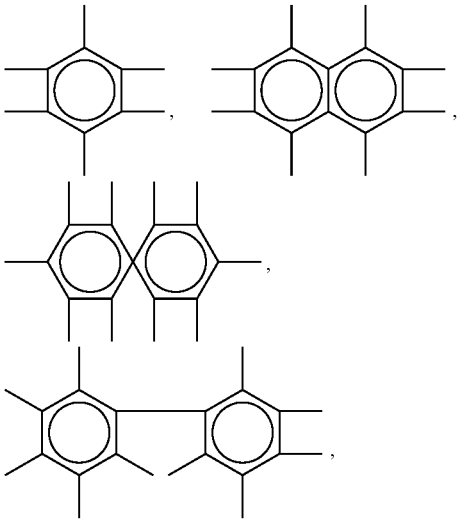

-continued

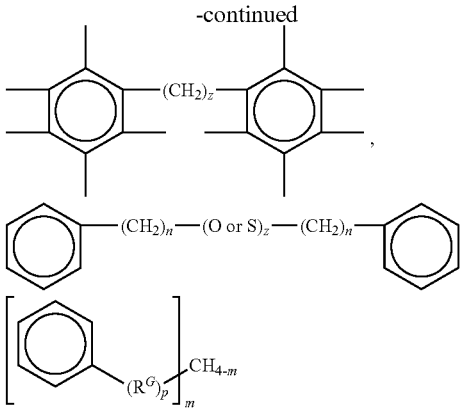

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol.

Phenolic type anti-oxidants are well known in the lubricating industry and commercial examples such as Ethanox® 4710, Irganox® 1076, Irganox®L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

Aromatic amine anti-oxidants include phenyl-α-naphthyl amine which is described by the following molecular structure:

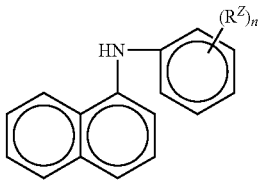

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine anti-oxidants can also be used.

Another class of anti-oxidant used in lubricating oil compositions and which may be present in addition to the necessary phenyl-α-naphthylamine is oil-soluble copper compounds. Any oil-soluble suitable copper compound may be blended into the lubricating oil. Examples of suitable copper anti-oxidants include copper dihydrocarbyl thio- or dithiophosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Such anti-oxidants may be used in an amount of about 0.50 to 5 wt %, preferably about 0.75 to 3 wt % (on an as-received basis).

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %, more preferably about 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers.

Such additives may be used in amount of about 0.0 to 0.5 wt %, preferably about 0 to 0.3 wt %, more preferably about 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof.

Such additives may be used in an amount of about 0.01 to 5 wt %, preferably about 0.01 to 1.5 wt %, more preferably about 0.01 to 0.2 wt %, still more preferably about 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to about 0.5 wt %, more preferably about 0.001 to about 0.2 wt %, still more preferably about 0.0001 to 0.15 wt % (on an as-received basis) based on the total weight of the lubricating oil composition.

Inhibitors and Anti-Rust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt % on an as-received basis.

Anti-wear additives can also advantageously be present. Anti-wear additives are exemplified by metal dithiophosphate, metal dithiocarbamate, metal dialkyl dithiophosphate, metal xanthage where the metal can be zinc or molybdenum. Tricresylphosphates are another type of anti-wear additive. Such anti-wear additives can be present in an amount of about 0.05 to 1.5 wt %, preferably about 0.1 to 1.0 wt %, more preferably about 0.2 to 0.5 wt % contributing no more than 300 ppm phosphorous to the finished oil.

Comparative Example and Example

A series of engine oils was evaluated in regard to the affect base stock composition and detergent has on traction coefficient. The engine oils were either a commercially available oil or the additized base stock blend. The traction coefficient was measured employing the MTM Traction Rig which is a fully automated Mini Traction Machine traction measurement instrument. The rig is manufactured by PCS Instruments and identified as Model MTM. The test specimens and apparatus configuration are such that realistic pressures, temperatures and speeds can be attained without requiring very large loads, motors or structures. A small sample of fluid (50 ml) is placed in the test cell and the machine automatically runs through a range of speeds, slide-to-roll ratios, temperatures and loads to produce a comprehensive traction map for the test fluid without operational intervention. The standard test specimens are a polished 19.05 mm ball and a 50.0 mm diameter disc manufactured from AISI 52100 bearing steel. The specimens are designed to be single use, throw away items. The ball is loaded against the face of the disc and the ball and disc are driven independently by DC servo motors and drives to allow high precision speed control, particularly at low slide/roll ratios. Each specimen is end mounted on shafts in a small stainless steel test fluid bath. The vertical shaft and drive system which supports the disk test specimen is fixed. However, the shaft and drive system which supports the ball test specimen is supported by a gimbal arrangement such that it can rotate around two orthogonal axes. One axis is normal to the load application direction, the other to the traction force direction. The ball and disk are driven in the same direction. Application of the load and restraint of the traction force is made through high stiffness force transducers appropriately mounted in the gimbal arrangement to minimize the overall support system deflections. The output from these force transducers is monitored directly by a personal computer. The traction coefficient is the ratio of the traction force to the applied load. As shown in FIG. 1, the traction coefficient was measured over a range of speeds. In FIG. 1, the speed on the x-axis is the entrainment speed, which is half the sum of the ball and disk speeds. These entrainment speeds simulate the range of surface speeds, or at least a portion of the range of surface speeds, reached when the engine is operating.

The test results presented in this patent application were generated under the following conditions:

| | |
|---|---|
| Temperature | 100° C. |
| Load | 1.0 GPa |
| Slide-to-roll ratio (SRR) | 50% |
| Speed gradient | 0-3000 mm/sec in 480 seconds |

The lubricating oils are described in Table 1.

TABLE 1

| Oil Designation | Detergent System (wt % Active) (TBN of Full Blend) | Base Stock | Lubricating Oil KV @ 100° C. |
|---|---|---|---|
| Ref. A | Overbased Calcium Phenate (11.5%)/ Overbased Ca Sulfonate (3.1%) (70) | Group I (12 $mm^2/s$)/ PIB (2200 MW) | 20 $mm^2/s$ |
| Ref. B | Overbased Ca Phenate (11.5%)/ Overbased Ca Salicylate (4.7%) (70 BN) | Group I (8 $mm^2/s$) Group I (32 $mm^2/s$) | 22 $mm^2/s$ |
| Ref. C | Overbased Ca Phenate (11.5%)/ Overbased Ca Salicylate (4.7%) (70 BN) | Group I (12 $mm^2/s$)/ Group IV (150 $mm^2/s$) | 21 $mm^2/s$ |
| Oil I | Overbased Ca Phenate (11.5%)/ Overbased Ca Salicylate (4.7%) (70 BN) | Group I (4 $mm^2/s$)/ Group IV (150 $mm^2/s$) | 20 $mm^2/s$ |

As can be seen by reference to FIG. 1, Oil I, the 70 Base Number cylinder oil comprising the mixture of a Group I base stock (KV at 100° C. of 4 $mm^2/s$) and a Group IV base stock (PAO150 KV at 100° C. of about 150 $mm^2/s$) containing a detergent, in this case a mixture of calcium phenate and calcium salicylate (active ingredient ratio of about 2.5:1), exhibited a significantly reduced traction coefficient relative to Reference Oils A, B and C at speeds of at least 60 mm/s and higher.

Oil I also yielded a reduced traction coefficient relative to Reference Oil A under very low speeds (about 3 to 8 mm/s).

Reference Oil A is a commercial oil utilizing a phenate/sulfonate detergent combination with other additives in a Group I (12 $mm^2/s$)/PIB (2200 MW) base oil combination.

Reference Oil B utilizes a phenate/salicylate detergent combination and the same other additives as Reference Oil A and Oil I but with a bimodal blend of Group I base oils. This oil yields traction coefficient performance essentially equivalent to Reference Oil A.

Reference Oil C utilizes the same detergents and other additives as Reference Oil B and Oil I but with a bimodal blend of Group I (12 $mm^2/s$) and Group IV (PAO 150) base oils. No significant benefit in traction coefficient is seen relative to Reference Oil A or Reference Oil B.

Based on these data, the kinematic viscosity of the Group I base oil of the bimodal Group I/Group IV base oil blend of Oil I must be less than 12 $mm^2/s$ to yield a significant traction coefficient improvement over Reference Oil A.

What is claimed is:

1. A method for improving the fuel economy of large low and medium speed engines that reach surface speeds of at least 3 mm/s and are lubricated by an engine oil by reducing the traction coefficient of the engine oil used to lubricate the engine by employing as the engine oil a lubricating oil having a kinematic viscosity at 100° C. of about 20 to 25 $mm^2/s$ comprising a base oil comprising a bimodal blend of two different base oils, the first base oil being one or more oils selected from the group consisting of Group I base oils having a kinematic viscosity at 100° C. of from 4 to 8 $min^2/s$ and a second base oil selected from one or more oils selected from Group IV base oils having a kinematic viscosity at 100° C. of 38 $mm^2/s$ to 150 $mm^2/s$, and containing one or more detergents selected from the group consisting of alkaline earth metal sulfonate, salicylate, carboxylate, salicylate/sulfonate, phenate/salicylate, phenate/sulfonate, and phenate/carboxylate in an amount in the range of 6 to 30 wt % based on active ingredient wherein the improvement in the fuel economy is evidenced by the engine oil having a coefficient of traction which is lower than the coefficient of traction as compared to engine oils which are not bimodal or which are based on Group I base oils or mixtures of Group I base oils and PIB.

2. The method of claim 1 wherein the detergent is selected from the group consisting of the mixture of alkaline earth metal salicylate and alkaline earth metal phenate.

3. The method of claim 2 wherein the weight ratio of phenate to salicylate is in the range 3:1 to 1:3.

4. The method of claim 1 wherein the second base oil is mPAO base oil produced employing metallocene catalysis.

5. The method of claim 2 wherein the second base oil is mPAO base oil produced employing metallocene catalysis.

6. The method of claim 3 wherein the second base oil is mPAO base oil produced employing metallocene catalysis.

7. The method of claim 1 wherein the second base oil is PAO base oil characterized by not more than 5.0 wt % of the polymer having a molecular weight of greater than 45,000 Daltons.

8. The method of claim 2 wherein the second base oil is PAO base oil characterized by not more than 5.0 wt % of the polymer having a molecular weight of greater than 45,000 Daltons.

9. The method of claim 3 wherein the second base oil is PAO base oil characterized by not more than 5.0 wt % of the polymer having a molecular weight of greater than 45,000 Daltons.

* * * * *